United States Patent [19]

Rudy et al.

[11] 4,238,531

[45] Dec. 9, 1980

[54] ADDITIVES FOR CLOTHES DRYERS

[75] Inventors: Jerome Rudy, Livingston, N.J.; Anthony A. Rapisarda, Elmhurst, N.Y.

[73] Assignee: Lever Brothers Company, New York, N.Y.

[21] Appl. No.: 853,663

[22] Filed: Nov. 21, 1977

Related U.S. Application Data

[60] Continuation of Ser. No. 589,993, Jun. 24, 1975, abandoned, which is a continuation of Ser. No. 376,586, Jul. 5, 1973, abandoned, which is a division of Ser. No. 158,090, Jun. 29, 1971, abandoned.

[51] Int. Cl.[2] ..... B05D 3/12

[52] U.S. Cl. ..... 427/242; 34/9; 252/8.6; 252/8.8; 252/8.9; 428/537; 428/538

[58] Field of Search ..... 252/8.6, 8.9, 8.8; 427/242; 428/279, 511, 530, 537, 538; 34/9, 60; 118/76

[56] References Cited

U.S. PATENT DOCUMENTS

| | | | |
|---|---|---|---|
| 1,030,909 | 7/1912 | Mesturino | 117/137 X |
| 2,048,293 | 7/1936 | Richter et al. | 117/154 |
| 2,246,085 | 6/1941 | Arnold | 117/154 A X |
| 2,776,913 | 1/1957 | Anderson | 117/158 X |
| 2,783,161 | 2/1957 | Padgett | 117/154 X |
| 3,227,614 | 1/1966 | Scheuer | 117/154 X |
| 3,356,526 | 12/1967 | Waldman et al. | 117/100 |
| 3,442,692 | 5/1969 | Gaiser | 117/120 |
| 3,573,091 | 3/1971 | Waldman et al. | 117/100 |
| 3,632,396 | 1/1972 | Perez-Zamora | 117/76 P |
| 3,686,025 | 8/1972 | Morton | 117/140 R |
| 3,895,128 | 7/1975 | Gaiser | 427/242 X |
| 4,012,326 | 3/1977 | Rudy et al. | 427/242 X |

*Primary Examiner*—Evan K. Lawrence

*Attorney, Agent, or Firm*—Michael J. Kelly; James J. Farrell; Melvin H. Kurtz

[57] ABSTRACT

A novel method for applying adjuvants to fabric employing a tumbler-type dryer is disclosed. To achieve uniform distribution in the dryer, the adjuvant, in accordance with the present invention, is diluted with a diluent spreadable under the dryer conditions, the concentration of the adjuvant in the diluent being effective but not in excess of about 95% by weight. Novel compositions of matter and articles suitable for use in the practice of this invention are also disclosed.

10 Claims, No Drawings

ADDITIVES FOR CLOTHES DRYERS

CROSS-REFERENCES TO RELATED APPLICATIONS

This is a continuation of application Ser. No. 589,993 filed June 24, 1975, abandoned; which is a continuation of application Ser. No. 376,586, filed July 5, 1973, abandoned; which is a divisional of application Ser. No. 158,090, filed June 29, 1971, abandoned.

BACKGROUND OF THE INVENTION

This invention relates to a novel method of applying adjuvants to clothing in tumbler-type drying machines and to compositions of matter and articles suitable for use with the method.

It has been customary for many years to include various adjuvants in detergents and wash-cycle additives. Germicides, fabric softeners and optical brighteners are among the most common such adjuvants used. However, other materials, such as ironing aids, antistatic agents, stain repellents, soil release agents, wrinkle preventatives, deodorizers, fresheners (e.g., perfumes, etc.), cleaning agents, surfactants, flameproofing agents, mothproofing agents, bleaching agents, etc. are also products which potentially can be applied to fabrics employing the method of the present invention. A particular advantage of the present invention is that it is possible to obtain much more efficient and convenient application of the adjuvant to the clothing than can be obtained if the adjuvant is applied in the wash or rinse cycles.

In the wash or rinse cycles, the primary objective is to remove soil, etc. from the cloth being washed by means of detergents, water and emulsifying agents. The presence of detergents and emulsifying agents effective to remove soil from the cloth manifestly renders difficult and less efficient the concurrent application of adjuvants such as fabric softeners or other adjuvants to the same piece of material. Since in the drying cycle following washing and rinsing, the conditions characteristic of the rinsing and washing cycles leading to inefficient application of the fabric adjuvants are not present, there is the potential for the much more efficient utilization and application of such adjuvants.

Due to the heat and mechanical action and residual water on the fabrics in the dryer, it might be expected that fabric adjuvants could be easily and uniformly applied in the dryer. Experience demonstrates, however, that this does not readily occur. For example if clothing to be treated with a fabric softening agent is placed into a dryer together with a pure fabric softening active ingredient such as distearyl dimethyl ammonium chloride, the softener will be somewhat spread throughout the clothing treated, but it will be far from uniformly spread. This may result in unsightly spots on cloth or lead to water repellency. While the problem of nonuniformity of spreading may be alleviated in repeated applications of the adjuvant, more preferable results are obtained if the adjuvant is combined with a distributing agent.

SUMMARY OF THE INVENTION

The present invention is a method of applying adjuvants to a fabric in a tumbler-type dryer and compositions of matter and articles suitable for use with the method. To achieve uniform distribution in the dryer, the adjuvant, in accordance with the method of the present invention, is diluted with a diluent spreadable under the dryer conditions, the concentration of the adjuvant in the diluent being effective but not in excess of about 95% by weight.

Preferred compositions for use in the present invention generally contain at least about 80% by weight of the distributing agent: however, the spreadability of fabric adjuvants when applied to fabrics may be improved in compositions containing as little as 5% distributing agent. Preferably, the amount of adjuvant is at least 10% of the complete composition especially where the distributing agent is water-insoluble. The minimum concentration of the adjuvant needed to obtain the desired modification of the fabric without requiring excessive quantities of distributing agent or leaving excessive residues of distributing agent on the fabric, referred to hereinafter as "effective concentration," will depend on both the nature and level of the distributing agent and the nature of the adjuvant.

Suitable distributing agents for use in the present invention generally are innocuous substances which, after formulation, are meltable, sublimable soluble or softenable or otherwise spreadable at the temperatures encountered in the dryer. As a general rule, temperatures commonly encountered in home drying machines are in the order of from 75° to 200° F. It may be noted in this connection that a number of organic compounds are very effective distributing agents even though in the pure state they have melting points, softening points, etc., substantially above the temperatures encountered in drying machines. It will be understood, therefore, that when referring to the melting points or softening points relative to temperatures encountered in the drying machines, the melting point or softening point which controls the effectiveness of the spreading agent is the melting point or softening point of the formulated material containing both distributing agent and active ingredient rather than the melting point of the chemically pure substances.

Suitable materials which can be used as distributing agents in accordance with the present invention include, but are not limited to urea which is soluble in the entrained water accompanying the spun-dried clothing; ammonium carbonate which volatilizes at temperatures encountered in the drying machine; short chain quaternary compounds of the formula $[N(R_2R_7R_8R_8)]yX$ wherein $R_2$ is a $C_1$–$C_4$ alkyl, $R_7$ is a $C_{10}$–$C_{14}$ alkyl and each $R_2$ is either $R_2$ or $R_7$, X is an anion imparting water dispersibility and y is the valency of X, which generally are molten or softened at dryer temperatures: nonionic compounds such as ethoxylated fatty alcohols, which are molten or softened at dryer temperatures, and, moreover, because of their surface active characteristics, tend to promote spreading lower molecular weight innocuous carboxylic acids such as citric acid, tartaric acid, gluconic acid, etc., which are soluble in the water accompanying spun-dried clothing and because of their acidity tend to promote solubilization and spreading of cationic fabric softeners. In certain cases, water has been found an effective distributing agent. It will be appreciated that not all of the foregoing distributing agents are equally effective. Urea and ammonium carbonate have been found to be highly effective whereas other materials such as water are of lesser effectiveness, and are best employed only when applying the adjuvant through special techniques.

Other distributing agents include, but are not limited to: phenyl stearyl trimethyl ammonium chloride, di-(phenyl stearyl) dimethyl ammonium chloride, propylene glycol, silica gel and combinations of the above; ethoxylated amines such as those described in U.S. Pat. No. 2,979,528, fatty acids, Carbowax (polyethylene glycols), and block polymers of polyethylene glycol and polypropylene glycol such as described in U.S. Pat. Nos. 2,674,619 and 2,677,700.

Adjuvants which can be employed in the present invention have already been described in general above. Specific adjuvants which may be used in conjunction with the foregoing spreading agents include fabric softeners of the formula $[N(R_1R_2R_3R_3)]yX$, and the reaction product of about 2 moles of a fatty acid of the formula $R_4COOH$ and hydroxyalkyldiamine of the formula

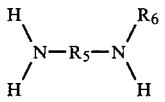

wherein $R_1$ is a $C_{16}$ to $C_{20}$ alkyl group, $R_2$ is a $C_1$ to $C_4$ alkyl group, each $R_3$ is selected from the group consisting of $R_1$ and $R_2$, $R_4$ is a $C_{15}$ to $C_{19}$ alkyl group, $R_5$ is a $C_1$–$C_3$ divalent hydrocarbon radical and $R_6$ is a hydroxyalkyl group of from 1 to 3 carbon atoms, X is cation imparting water dispersibility to the cationic ammonium compound, and y is the valency of X. Typical commercial products commonly available for use in the present invention include distearyl dimethyl ammonium chloride and the reaction product of approximately 2 moles of stearic acid with approximately 1 mole of hydroxyethylene diamine. This last-mentioned product is a mixed chemical structure in view of the multi-functional characteristic of the diamine reactant. Spectral analysis of a commercial product indicates that it contains in the order of 25% quaternary compounds of the imidazoline type, the balance thereof being mixed esters and amides. Softeners related to the fatty acid-diamine condensate also include the quaternized products of about 2 moles of oleic acid reacted with 1 mole of hydroxyethyl ethylene diamine and the product of about 2 moles of a mixture of oleic and stearic acids reacted with 1 mole of hydroxyethyl ethylene diamine. These materials may optionally be combined with a nonionic dispersant.

Other adjuvants which may be applied by this invention include, but are not limited to: optical brighteners such as disulfonated diaminostilbene compounds disclosed in Alien Property Custodian publication No. 381,856 and U.S. Pat. No. 2,612,501, and the monotriazole compounds of the type disclosed in U.S. Pat. No. 2,784,183; water soluble or dispersible fragrances; antistatic agents; germicides, e.g., polybromosalicylanilide, tribromosalicylanilide, hexachlorophene, neomycin sulfate, alkyl dimethyl ethylbenzyl ammonium chloride; bodying agents, e.g., methocel, carboxymethyl cellulose, starch, polyvinyl acetate; and soil release agents, e.g., polyacrylic resin or polyvinyl alcohol.

In the application of fabric softeners in accordance with the present invention, increasing the hydrophilic characteristics of the cationic fabric softening compound improves the uniformity of distribution. This is believed to come about because of the greater ease with which hydrophilic compounds may be spread on fabric which contains unevaporated water.

While reference has been made in describing specific embodiments to the use of certain fabric softening compounds, the present invention is not limited thereto, but is generally directed to the application of any fabric adjuvant, of which fabric softeners are representative, by means of a distributing agent in a tumbler-type dryer.

In the practice of the present invention, the product may be prepared in any convenient form for application in the dryer. For example, the material may be prepared as a liquid formulation to be applied as a spray to the clothing as it is placed in the dryer; as powders, chips, granules, flakes and the like, to be added to the dryer together with the clothing; or on a suitable backing or mounting strip (paper, plastic or metallic) which may be fixed to the dryer drum or the dryer door or convenient location within the dryer via adhesive, suction or magnetic means. This form of product (strip or sheet) obviates the loss of product that may occur through the dryer holes when the product is prepared in powder or fine chip form. Many other forms will be obvious to those skilled in the art. It may be pointed out in this connection that for the purpose of moistening the clothes in the clothes dryer and rendering them more easily ironable, perforated balls have been employed filled or partially filled with water. The use of such a ball filled or partially filled with a liquid form of the adjuvant-distributor combination of the present invention offers a particularly convenient method for applying material to the clothing in the clothes dryer. A ball of this type fabricated from sponge material (e.g., polyurethane) would be convenient and give less noise in the dryer. Large friable balls or tablets which will rub off and disperse on the clothing and drum surface as they are subjected to the mechanical action of the tumbler drum may also be prepared. It should also be noted, particularly in connection with solid formulations, that many clothes dryers are constructed with perforated surfaces on the drying or tumbler drum. Powdered forms of the adjuvant compositions of the present invention when employed in machinery of this type may tend to be lost through the perforations of the dryer drum. Accordingly, when formulating as chips or granules the dimensions should be sufficient to avoid loss through the perforations of the drum.

EXAMPLE 1

A fabric softening composition was prepared by co-melting urea and distearyldimethyl ammonium chloride to form a complex of these two materials. The distearyldimethyl ammonium chloride comprised 10% by weight of the total material. The melt was spread upon a sheet and allowed to harden. It was then broken into chips of approximately 3/8 of an inch across. These chips were added to the dryer along with spun-dry swatches of cloth. Fifty grams of chips were used for eight pounds of spun-dry clothing. The dryer used was a Hotpoint Speed-Flow Silhouette.

The cloth swatches were dried to dryness in a 45-minute cycle. The dried material was evaluated qualitatively and found to have excellent hand and softness.

The foregoing experiment was repeated employing blue tracer dye in small concentration in the urea-distearyldimethyl ammonium chloride complex to visually assess the uniformity of distribution. The uniformity of distribution was found to be good. Measurement of the residue of the urea-fabric softener chips found in the dryer after the drying cycle showed that a substantial portion of the fabric softener had been picked up by the clothing.

EXAMPLE 2

A formulation was prepared containing 90% of the ethylene oxide condensate of mixed $C_{12}$–$C_{14}$ fatty alcohols. The condensate contained approximately 10 moles of ethylene oxide per mole of alcohol. The fabric softening ingredient was again distearyl dimethyl ammonium chloride.

The mixture of fabric softener and ethylene oxide-alcohol condensate was blended while melting and allowed to cool and harden on a sheet of metallic foil. The sheet was then taped to the interior surface of the drum of the drying machine. A sufficient quantity of fabric softener was employed to provide about 25 grams of formulation per pound of clothing (spun dried) added to the drying machine. Excellent softening was obtained and, as indicated in a parallel experiment employing a tracer dye, a high degree of uniformity of distribution was obtained in the clothing.

The following are examples of further fabric softening compositions which may be used in the present invention.

FABRIC SOFTENER FORMULATIONS

EXAMPLE 3

| | |
|---|---|
| The reaction product of mixed stearic and oleic acids with hydroxyethylethylenediamine quarternized with dimethyl sulfate | 6% |
| di(hardened tallow) dimethyl ammonium chloride | 4% |
| urea | 90% |

The foregoing composition may be employed as a sheet or film on a towelette or an adhesive-backed paper sheet, as pellets, flakes, powders, balls, etc.

EXAMPLE 4

| | |
|---|---|
| The reaction product of mixed stearic and oleic acids with hydroxyethylethylenediamine quarternized with dimethyl sulfate | 6% |
| Di(hardened tallow) dimethyl ammonium chloride | 4% |
| ethoxylated fatty alcohols ($C_{12}$–$C_{18}$) containing 60% ethylene oxide | 2.5% |
| urea | 87.5% |

The foregoing composition may be employed as a coating or film on a towelette or an adhesive-backed paper sheet, or as pellets, flakes, powders, balls, etc.

EXAMPLE 5

| | |
|---|---|
| The reaction product of mixed stearic and oleic acids with hydroxyethylethylenediamine quarternized with dimethyl sulfate | 6% |
| di(hardened tallow) dimethyl ammonium chloride | 4% |
| di coco dimethyl ammonium chloride | 2.5% |
| urea | 87.5% |

The foregoing composition may be employed as a coating on a towelette or adhesive-backed paper sheet, or as pellets, flakes, powders, balls, etc.

EXAMPLE 6

| | |
|---|---|
| The reaction product of mixed stearic and oleic acids with hydroxyethylethylenediamine quarternized with dimethyl sulfate | 6% |
| di(hardened tallow) dimethyl ammonium chloride | 4% |
| ethyl alcohol | 40% |
| fluorinated hydrocarbon propellant | 50% |

This material is applied as an aerosol sprayed to the surface of the dryer drum.

EXAMPLE 7

Example 6 may be modified by substituting partly or entirely one or more of the following fabric softeners for the fabric softening actives:

The reaction product of stearic acid with hydroxyethylethylenediamine,

The reaction product of stearic acid with hydroxyethylethylenediamine, combined with the condensate of ethylene oxide and oleyl alcohol having 20–25 ethyoxy units per mole, The reaction product of oleic acid with hydroxyethylethylenediamine, quaternized with dimethyl sulfate.

Example 6 may be further modified by replacing the alcohol vehicle with an alcohol-water mixture (1:1), and by substituting a hydrocarbon or other propellant for the fluorinated hydrocarbon propellant.

SOIL RELEASE FORMULATIONS

EXAMPLE 8

Permalose TG, a polyester polymer 10% having soil release properties

Polyethylene glycol, M. W.=4000 90%

This material may be coated on paper towelettes, adhesive-backed paper sheets, or used in the form of flakes, powders, tablets, etc.

EXAMPLE 9

Example 8 may be modified by substituting Rhoplex SR 488, a polyacrylic soil release agent described in U.S. Pat. No. 3,377,249, Perapret D which is another polyacrylic soil release agent, Cirrasol P. T. which is a polyoxyethylene terephthlate, FC 216 which is a fluorinated polymer having soil release properties, Agent 3 SR, which is another fluorinated polymer having soil release properties, carboxymethyl cellulose, methocellulose, or polyvinyl alcohol for Permalose TO. Example 9 may be further modified by substituting higher molecular weight polyethylene glycols, up to a molecular weight of 20,000, for the polyethylene glycol of Example 9.

EXAMPLE 10

| | |
|---|---|
| Permalose TG | 10% |
| Polyethylene glycol, m.w. = 4000 | 40% |
| Fluorinated hydrocarbon propellant | 50% |

The composition is applied as an aerosol by spraying the interior surface of the dryer drum.

OPTICAL BRIGHTENER FORMULATIONS

EXAMPLE 11

| | |
|---|---|
| An optical brightener of the class disclosed in APC publication 381,856 | 2% |
| polyethylene glycol, m.w. = 4000 | 98% |

The product is used in the form of a coating on a towelette or adhesive-backed paper sheet, or as pellets, powders, flakes, tablets, etc.

EXAMPLE 12

| | |
|---|---|
| An optical brightener of the class disclosed in APC publication 381,856 | 2% |
| triethanol amine | 48% |
| fluorinated hydrocarbon propellant | 50% |

This product is applied as an aerosol by spraying the interior surface of the dryer drum.

EXAMPLE 13

Examples 11 and 12 may be modified by substituting an optical brightener of the type disclosed in U.S. Pat. No. 2,734,183 for the brightener of Examples 11 and 12. Example 12 may also be modified by substituting dicocodimethyl ammonium chloride for all or a portion of the triethanol amine.

GERMICIDAL AND SANITIZER FORMULATIONS

EXAMPLE 14

| | |
|---|---|
| Polybromosalicylanilide | 5% |
| Polyethylene glycol, m.w. = 4000 | 95% |

The composition may be used as a coating on towelettes or adhesive-backed paper sheets, or in the form of pellets, powders, flakes, tablets, etc.

EXAMPLE 15

Example 14 may be modified by replacing the polybromosalicylanilide with dibromosalicylanilide, tribromosalicylanilide, trichlorocarbanilide, benzalkonium quaternary germicides, stearyl dimethyl benzoyl ammonium chloride, alkyl dimethyl benzoyl ammonium saccharinate, diisobutylphenoxyethoxyethyl dimethyl benzoyl ammonium chloride, oleyl trimethyl ammonium chloride, cocotrimethyl ammonium chloride, phenyl mercuric propionate or neomycin sulfate.

Example 14 may be further modified by formulating it as an aerosol to be sprayed on the surface of the dryer drum using a suitable propellant. In aerosol formulations, triethanol amine may be used as a solvent.

IRONING AIDS

EXAMPLE 16

| | |
|---|---|
| Paraffin | 10% |
| Polyethylene glycol, m.w. = 4000 | 90% |

The foregoing may be employed as a coating on a towelette or an adhesive-backed paper sheet, or as powders, flakes, pellets, tablets, etc.

EXAMPLE 17

Example 16 may be modified by substituting other ironing aids for paraffin. Illustrative materials include long chain alcohols, powdered polyethylene, powdered Teflon, and silicone oils. Example 16 may be further modified by formulating it as an aerosol using a suitable propellant.

FLAMEPROOFING FORMULATIONS

EXAMPLE 18

| | |
|---|---|
| Borax | 10% |
| Polyethylene glycol, m.w. = 4000 | 90% |

The foregoing may be employed as a coating on a towelette or an adhesive-backed paper sheet, or in the form of flakes, pellets, tablets, etc.

EXAMPLE 19

Example 18 may be modified by substituting sodium tripolyphosphate for borax. Example 18 may be further modified by formulating the composition with a suitable propellant for use as an aerosol.

WATER AND STAIN REPELLANT FORMULATIONS

EXAMPLE 20

| | |
|---|---|
| Calcium stearate | 10% |
| ethyoxylated alcohols ($C_{12}$-$C_{18}$) having about 60% ethylene oxide | 2% |
| polyethylene glycol, m.w. = 4000 | 88% |

The foregoing may be used as a coating on paper towelettes or adhesive-backed paper sheets, or it may be used in the form of powders, pellets, flakes, tablets, etc.

EXAMPLE 21

| | |
|---|---|
| Perfluorocarboxylic acid of the formula $F(CH_2)nCOOH$ | 10% |
| polyethylene glycol, m.w. = 4000 | 90% |

The foregoing may be employed as a coating on a towelette or an adhesive-backed paper sheet, or in the form of powders, pellets, flakes, tablets, etc.

EXAMPLE 22

Examples 20 and 21 may be modified by substituting other organo-fluorine compounds known to provide stain repellancy. These examples may be further modified by providing for a suitable propellant for use as an aerosol.

SOIL RELEASE AND CLEANSING FORMULATIONS

EXAMPLE 23

| | |
|---|---|
| linear alkyl benzene sulfonate | 10% |
| polyethylene glycol, m.w. = 4000 | 90% |

EXAMPLE 24

| | |
|---|---|
| ethoxylated linear primary alcohols ($C_{14}$–$C_{15}$) having 11 E.O. units per mole | 10% |
| polyethylene glycol, m.w. = 4000 | 90% |

EXAMPLE 25

| | |
|---|---|
| polyoxyethylene sorbitan tristearate | 10% |
| the condensate of ethylene oxide with polyoxypropylene | 90% |

EXAMPLE 26

| | |
|---|---|
| polyoxyethylene stearate | 80% |
| the condensate of ethylene diamine with ethylene oxide and propylene oxide | 20% |

EXAMPLE 27

Example 27 describes a fabric softener formulation demonstrating the beneficial effect of a low level of the distributing agent.

| | Parts by Weight as Prepared | % Composition After Appln. to Paper | Distribution | Pick-up |
|---|---|---|---|---|
| Softener A, Active[a] | 5.0 | 50.0 | Good | Good |
| Softener B, Active[b] | 5.0 | 50.0 | | |
| Inert[c] | 1.7 | — | | |
| Softener A, Active[a] | 5.0 | 45.5 | Very Good | Excellent |
| Softener B, Active[b] | 5.0 | 45.5 | | |
| Inert[c] | 1.7 | — | | |
| Nonionic Spreading[d] | 1.0 | 9.0 | | |
| Softener A, Active[a] | 5.0 | 45.5 | Very Good | Excellent |
| Softener B, Active[b] | 5.0 | 45.5 | | |
| Inert[c] | 1.7 | — | | |
| Nonionic Spreading Agent[e] | 1.0 | 9.0 | | |

[a]"Tallow" amidoimidazoline quaternized with diethyl sulfate.
[b]Dimethyl distearyl ammonium chloride.
[c]Mainly alcohol introduced with [b]. Components [b] and [c] were added as a commercial material containing 75% [b] and 25% [c].
[d]Condensate of a mixture of about ⅔$C_{16}$ and about ⅓$C_{18}$ aliphatic alcohols, and ethylene oxide. The condensate contains about 65% ethylene oxide.
[e]Condensate of a mixture of about ⅔$C_{12}$ and about ⅓$C_{18}$ aliphatic alcohols, and ethylene oxide. The condensate contains about 60% ethylene oxide.

In the foregoing examples of illustrative formulations within the scope of the present invention, each formulation has been directed to a composition serving a single functional purpose. If desired, multifunctional compositions may be prepared, having due regard for difficulties arising from the use of incompatible materials. By way of illustration, Example 5 above includes 2.5% of dicocodimethyl ammonium chloride, a compound possessing some bactericatatic activity. This formulation may be further modified by incorporating a suitable amount of long-chain fatty alcohol (as an ironing aid), calcium stearate (as a stain repellant), and a fabric brightener of the type disclosed in APC publication 361,836. It will be obvious that it is common commercial practice also to provide a fragrance to improve consumer acceptability.

We claim:

1. An article of manufacture consisting essentially of (1) a composition for application of an adjuvant to a fabric in a tumbler-type dryer, consisting essentially of an adjuvant for said fabric and a distributing agent therefor, said adjuvant being present in an effective concentration not exceeding about 95% by weight and being selected from the group consisting of fabric softeners, optical brighteners, antistatic agents, stain repellents, soil release agents, wrinkle preventatives, deodorizers, fresheners, cleaning agents, surfactants, moth proofing agents, and bleaching agents and said distributing agent being selected from the group consisting of ammonium carbonate, short chain quaternary compounds of the formula $[N(R_2R_7R_8R_8)]yX$ wherein $R_2$ is a $C_1$–$C_4$ alkyl, $R_7$ is a $C_{10}$–$C_{14}$ alkyl, each $R_8$ is selected from the group consisting of $R_2$ and $R_7$, X is an anion imparting water dispersibility and y is the valency of X, condensates of alkyl alcohols and ethylene oxide which melt at dryer temperatures, and lower molecular weight, innocuous carboxylic acids which promote the spreading of the adjuvant, and which are soluble in the water accompanying spun-dried clothes, and (2) a means for applying said composition to the fabric in said dryer.

2. An article of manufacture according to claim 1 wherein said means is a backing sheet.

3. An article of manufacture according to claim 2 wherein the backing sheet is paper.

4. In a method for applying an adjuvant to a fabric in a tumbler-type dryer, the improvement which comprises adding said adjuvant for the fabric to the dryer in combination with a distributing agent for the adjuvant, said adjuvant being present in an effective concentration not exceeding about 95% by weight, based on the combined weight of the adjuvant and distributing agent, and being selected from the group consisting of fabric softeners, optical brighteners, antistatic agents, strain repellents, soil release agents, wrinkle preventatives, deodorizers, fresheners, cleaning agents, surfactants, moth proofing agents, and bleaching agents, and said distributing agent being selected from the group consisting of ammonium carbonate, short chain quaternary compounds of the formula $[N(R_2R_7R_8R_8]yX$ wherein $R_2$ is a $C_1$–$C_4$ alkyl, $R_7$ is a $C_{10}$–$C_{14}$ alkyl, each $R_8$ is selected from the group consisting of $R_2$ and $R_7$, X is an anion imparting water dispersibility and y is the valency of X, condensates of alkyl alcohols and ethylene oxide which melt at dryer temperatures, and lower molecular weight, innocuous carboxylic acids which promote the spreading of the adjuvant, and which are soluble in the water accompanying spun-dried clothes.

5. A method according to claim 4 wherein said adjuvant is a fabric softening agent selected from the group consisting of (1) quaternary ammonium compounds of the formula $[N(R_1R_2R_3R_3)]yX$ wherein $R_1$ is $C_{16}$–$C_{20}$ alkyl, $R_2$ is $C_1$–$C_4$ alkyl, each $R_3$ is selected from the group consisting of $R_1$ and $R_2$, X is an anion imparting water dispersibility and y is the valency of X, and (2) the reaction product of about two moles of a fatty acid of the formula $R_4COOH$ and about one mole of a diamine of the formula

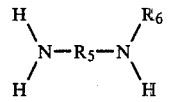

wherein $R_4$ is a $C_{15}$–$C_{19}$ alkyl, $R_5$ is a $C_2$ divalent hydrocarbon radical and $R_6$ is a $C_1$–$C_3$ hydroxy alkyl, said reaction product containing in the order of 25% quaternary compounds of the imidazoline type, the balance thereof being mixed esters and amides, and amidoimidazolines.

6. A method according to claim 5 wherein said adjuvant is a quaternary compound of the formula $[N(R_1R_2R_3R_3)]yX$ wherein $R_1$ is $C_{16}$–$C_{20}$ alkyl, $R_2$ is $C_1$–$C_4$ alkyl, each $R_3$ is selected from the group consisting of $R_1$ and $R_2$, X is an anion imparting water dispersibility and y is the valency of X.

7. A method according to claim 4 wherein the adjuvant and distributing agent are added in combination with a means for applying said adjuvant and said distributing agent to said dryer.

8. A method according to claim 7 wherein said means is a backing sheet.

9. A method according to claim 8 wherein said backing sheet is paper.

10. A composition for application to a fabric in a tumbler-type dryer, consisting essentially of an adjuvant for said fabric and a distributing agent therefor, said adjuvant being present in an effective concentration not exceeding about 95% by weight and being selected from the group consisting of fabric softeners, optical brighteners, antistatic agents, stain repellents, soil release agents, wrinkle preventatives, deodorizers, fresheners, cleaning agents, surfactants, moth proofing agents, and bleaching agents, and said distributing agent being selected from the group consisting of short chain quaternary compounds of the formula $[N(R_2R_7R_8R_8)]yX$ wherein $R_2$ is a $C_1$–$C_4$ alkyl, $R_7$ is a $C_{10}$–$C_{14}$ alkyl, each $R_8$ is selected from the group consisting of $R_2$ and $R_7$, X is an anion imparting water dispersibility and y is the valency of; X and condensates of alkyl alcohols and ethylene oxide, wherein said distributing agent melts at dryer temperatures and promotes the spreading of the adjuvant.

* * * * *

UNITED STATES PATENT AND TRADEMARK OFFICE

CERTIFICATE OF CORRECTION

PATENT NO. : 4,238,531

DATED : December 9, 1980

INVENTOR(S) : Jerome Rudy, et al

It is certified that error appears in the above—identified patent and that said Letters Patent is hereby corrected as shown below:

Column 1, line 10, after the word "abandoned" insert the words --which in turn was a continuation of Serial Number 821,476, filed May 2, 1969, now abandoned.--

Under "Related U.S. Application Data" on the title page of the patent document, insert the following statement after the words "Jun. 29, 1971, abandoned":

--which in turn was a continuation of Serial Number 821,476, filed May 2, 1969, now abandoned.--

Signed and Sealed this

*Thirteenth* Day of *March 1984*

[SEAL]

*Attest:*

GERALD J. MOSSINGHOFF

*Attesting Officer*

*Commissioner of Patents and Trademarks*